United States Patent [19]

Leuchter

[11] 4,176,939

[45] Dec. 4, 1979

[54] DEVELOPING APPARATUS WITH CONTACT-FREE LIGHT TRAP

[75] Inventor: Jürgen Leuchter, Tutzing, Fed. Rep. of Germany

[73] Assignee: AGFA-Gevaert, A.G., Leverkusen, Fed. Rep. of Germany

[21] Appl. No.: 830,442

[22] Filed: Sep. 6, 1977

[30] Foreign Application Priority Data

Sep. 9, 1976 [DE] Fed. Rep. of Germany ..... 2640634

[51] Int. Cl.[2] ..... G03D 13/04

[52] U.S. Cl. ..... 354/307; 354/312

[58] Field of Search ..... 354/277, 307, 308, 310, 354/311, 312, 313, 314, 315, 316, 319, 320, 321, 322, 338, 339; 134/64 P, 122 P

[56] References Cited

U.S. PATENT DOCUMENTS

| | | | |
|---|---|---|---|
| 2,475,973 | 7/1949 | Luboshez | 354/338 |
| 2,732,779 | 1/1956 | Beard et al. | 354/307 |
| 3,593,640 | 7/1971 | Gall | 354/314 |
| 3,672,290 | 6/1972 | Duesler | 354/321 |
| 3,879,030 | 4/1975 | Hommerin | 354/319 |

*Primary Examiner*—Donald A. Griffin
*Assistant Examiner*—Alan Mathews
*Attorney, Agent, or Firm*—Michael J. Striker

[57] ABSTRACT

A developing apparatus for photographic material has at least two containers for treating baths. These are so arranged that the photographic material travels through them in succession. A light trap connects the containers and the photographic material issuing from the upstream containers travels in a straight-line path through the light trap to reach the downstream container.

18 Claims, 2 Drawing Figures

DEVELOPING APPARATUS WITH CONTACT-FREE LIGHT TRAP

BACKGROUND OF THE INVENTION

1. Field of the Invention

This invention relates to apparatus for developing photographic materials, such as photographic sheets, photographic film and the like.

In particular, the invention relates to such a developing apparatus which has two or more containers for respective treating baths, through which the photographic material must travel in succession.

2. The Prior Art

Not all photographic materials are processed in the same way. Some require more processing steps or different treating chemicals than others. To make developing apparatus of the type here under discussion more flexible, i.e., more adaptable to these different requirements, it has already been proposed not to use a single large container and to subdivide it into a plurality of chambers for the treating baths, but instead to use a plurality of individual containers each of which is dimensioned to accommodate one of the treating baths. The apparatus can then be adapted for different requirements by simply adding or removing the requisite number of containers.

Such containers have a removable cover which closes them against the entry of light. Also, to permit travel of the photographic material into and out of the respective container, each such container has ports. The ports of successive containers are connected by guide elements through which the photographic material travels.

From time to time it is necessary to remove the cover of the respective container, e.g., for inspection purposes, for cleaning or for other reasons. When this occurs, it is important to prevent the incoming light from passing through the guide elements into the preceding and/or succeeding containers. For this purpose it has been proposed to mount a movable flap or door at each port, which closes automatically when the cover is removed. The disadvantage of this proposal is that the flaps contact the photographic material and tend to damage it (e.g., scratch the photographic emulsion). This is a particular danger if the machine is in operation and the material therefore in movement, when the cover is removed.

According to another proposal, lighttraps are arranged between the ports of the successive container. These traps prevent the travel of light between the containers by defining an interior passage in which the photographic material (e.g., a film) is forced to travel in a series of loops. Since the containers must usually be located close together to save space, the trap cannot be long and hence the loops must be very tight so that the requisite number of loops can be accommodated. Photographic material which is processed in this kind of apparatus must be available as a long band; hence, successive films, film strips or the like are glued or otherwise joined together to form this band which then travels through the apparatus. When the joints travel through the tight loops in the prior-art light traps, however, they tend to separate because of the small radii through which the material is deflected as it negotiates the loops.

SUMMARY OF THE INVENTION

It is an object of the invention to overcome the prior-art disadvantages.

More particularly, it is an object of the invention to provide a developing apparatus of the type under discussion, in which the travel of light from one to another container is reliably precluded without damage to the photographic material.

Another object is to provide such an apparatus in which separation of the joints of photographic material is avoided.

An additional object of the invention is to provide such an apparatus wherein the problem of preventing light-transfer between successive containers is solved in a simple and economical manner.

In keeping with these objects and with others which will become apparent hereafter, one aspect of the invention resides—in an apparatus for developing photographic material—in a combination comprising at least two adjacent containers each adapted to contain a treating bath for photographic material, the containers having respective ports which face one another; and means forming a passage which connects the ports and through which the photographic material travels from one to the other of the containers, and including a light trap in the passage and defining a substantially straight-line travel path for the photographic material.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
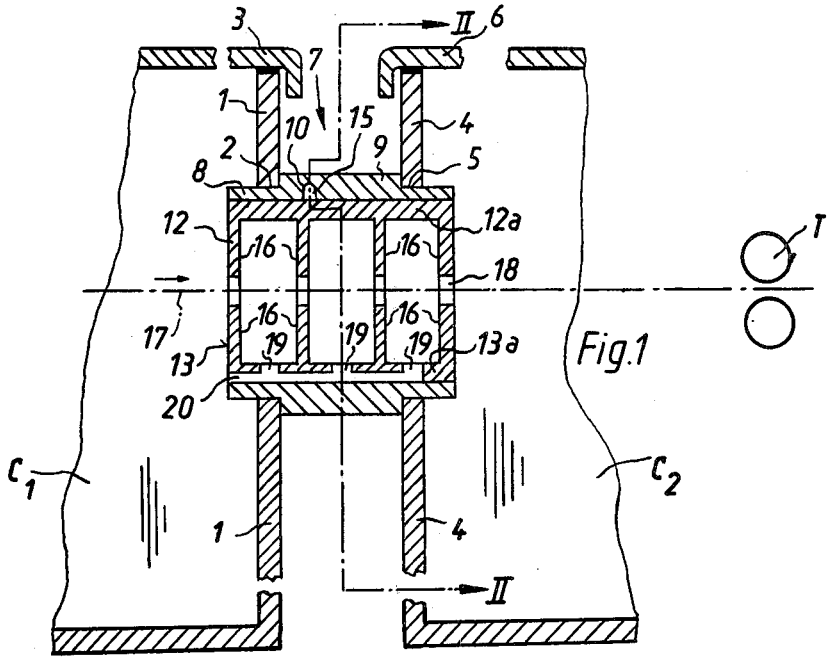
FIG. 1 is a fragmentary vertical section through two successive containers of an apparatus embodying the invention.

The drawing shows only those elements of a developing apparatus for photographic materials (such as films) which are required for an understanding of the invention. In all non-illustrated respects the apparatus corresponds to those which are already known per se.

With this in mind it will be seen that reference numeral 1 designates a wall of a fragmentarily shown container C1. Adjacent to it is located a wall of a similarly fragmentarily shown container C2. Each of these containers is adapted to accommodate a treating bath, and a band of photographic material 17 (e.g., a series of appropriately joined films) is made to travel sequentially through these baths. Merely for completeness, a pair of transporting rollers T has been illustrated; these are intended to be representative of the transporting devices which are conventionally used in such developing apparatus to transport the material 17, and which are known per se.

The wall 1 has a (here circular) port 2 which faces a similar port 5 in wall 4. The containers C1 and C2 have respective removable covers 3, 6 which are shown only fragmentarily. The location and dimensioning of the ports 2, 5 is identical for all of the containers (there may self-evidently be more than the two illustrated containers C1, C2) so that any one container can be connected with any other container.

Such connection is established by means of a connecting element 7. As shown in FIG. 1 this element includes a conduit 8 of elastically deformable material (e.g., natural or synthetic rubber, or synthetic plastic material such as polyethylene, polyvinyl chloride or the like). Conduit 8 is connected to the containers C1, C2 by simply inwardly deforming its reduced-diameter end portions, inserting them into the ports 2, 5 and releasing the deformation pressure so that the end portions return to their original size and shape and snugly engage the surfaces bounding the ports 2 and 5. Since the center portion 9 has a larger outer diameter than the end portions it forms with them respective shoulders against which the walls 1 and 4 abut. Thus, the conduit 8 is firmly held against displacement. Of course, the conduit 8 could also have a constant outer diameter and be formed with grooves (e.g., annular grooves in its end portions) into which projections or the wall portions bounding the ports 2, 5 could engage to hold the conduit against movement.

A light trap in the conduit is composed of two identical semi-cylindrical shell sections 12 and 13 which are installed in the conduit in mirror-reversed relationship and contact one another with their edge faces (here in a longitudinal plane). Together, the semi-cylindrical walls 12*a*, 13*a* of the shell sections 12, 13 form a cylindrical wall having an outer diameter which is equal to the minor diameter of conduit 8 (or at most slightly greater than the same). Each shell section 12, 13 is provided (preferably of one piece by e.g., injection molding) with one or more projections 14 and 15; these extend into radial holes 10, 11 of conduit 8 to prevent any shifting or other displacement of the shell sections relative to the conduit.

Each shell section wall 12*a*, 13*a* is further provided with inwardly extending baffles 16. These extend substantially normal with reference to the path of travel in which the photographic material 17 advances through the light trap from container C1 to container C2. In the illustrated embodiment each of the shell sections has four of these baffles 16; the baffles of each shell section form with the baffles of the other shell section respective pairs of baffles which subdivide the interior of the light trap into three longitudinally adjacent compartments. There could, of course, be more than four baffles 16 in each shell section, to obtain a corresponding larger number of compartments. It is also possible to use only three baffles per shell section (thus obtaining two compartments); a smaller number is not advisable, however, because the light trap would then not fully fulfill its intended purpose.

Figure 2:
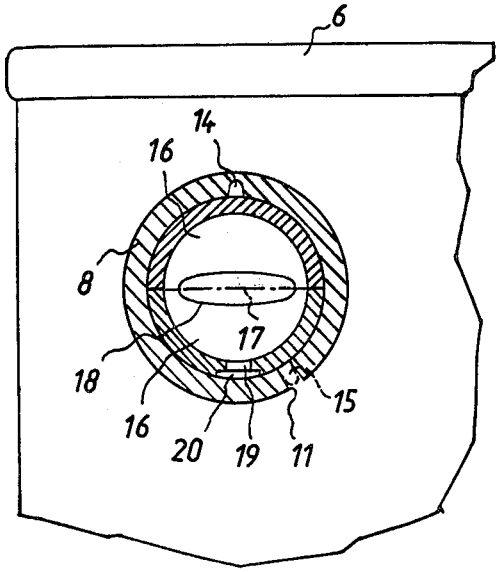
FIG. 2 is a section on line II—II of FIG. 1.

The successive baffles 16 may be spaced lengthwise of the light trap by non-uniform (unequal) distances or, as illustrated, they may be equidistantly spaced. Their shape is best shown in FIG. 2 from which it will be evident that the inner (facing) edges of each pair of upper and lower baffles 16 abut one another at the lateral sides, i.e., transversely spaced from the photographic material 17. The center parts of these inner facing edges may be parallel to one another and recessed from the lateral sides, or they may be arcuate in the illustrated manner to define (instead of a rectangular slot) a generally elliptical slot 18 of small height. The illustrated configuration of the slot 18 is particularly advantageous (but a rectangular or still other shape is possible) because the height of the slot tapers towards the lateral sides so that, if the material 17 shifts laterally (e.g., because of guidance difficulties) only its edges will contact the baffles 16 at the inclined portions of the inner edge faces; these portions then tend to deflect the material 17 back to the illustrated center position so that damage (scratching) to the emulsion on the material 17 is avoided.

The inner surfaces of the walls 12*a*, 13*a* must be dark and matte (not shiny) to eliminate the reflections as much as possible. The same is true of the surfaces of baffles 16. This can be obtained by applying a suitable paint or coating, unless the material of the walls 12*a*, 13*a* and the baffles 16 itself has the desired characteristic.

Since the material 17 travels in each container in a treating bath, some of the bath liquid will adhere to it as it enters the light trap. Enough liquid would eventually accumulate in the compartments to fill the same, which is evidently undesirable. Also, there is the danger that the treating liquid would be taken along into the next container (here the container C2) and contaminate the bath in the same. To avoid this, the lower shell section 13 is provided at or near the lowest point of each compartment with one or more holes 19. A collecting channel 20 is provided at the outer side of section 13 (e.g., formed of one piece with it) and communicates with all of the holes 19; it also is open to the upstream container (here C1) so that the liquid is returned to the bath in the same.

The shell-sections 12, 13 are advantageously also made of an elastically deformable material (e.g., natural or synthetic rubber or synthetic plastic); this may be the same material from which the conduit 8 is made. The use of such elastically deformable material permits elastic deformation of the shell-sections 12, 13 for the purpose of inserting them into or removing them from the conduit 8. Shell-sections 12, 13 may each be of one piece with their baffles 16, e.g., by being made via injection molding.

Whenever the cover (3 or 6) of one of the containers (C1, C2) is removed, the light will enter the container from above. Any of this light which enters through the first slot 18 of the light trap (on its way to the other container which is not uncovered) will be reflected into the nearest (first) compartment by the material 17 and absorbed therein. Light which enters the uncovered container under a very flat angle relative to the plane of material 17, is reflected into the second and third compartment and thereby absorbed. Only that component of incoming light which enters in (or substantially in) the same plane as material 17, might travel through the light trap into the other container. In view of the construction of the containers, including the fact that light can enter only from above when the cover is removed, this component of light is so small, however, that it is negligible and poses no problems.

Thus, the invention provides a light trap which prevents substantially all light from entering one container from another container, which avoids damaging of the photographic material, and which allows the photographic material to pass through it in a straight-line path and thus avoids separation of the joints where segments of the photographic material are connected to one another.

While the invention has been illustrated and described as embodied in a developing apparatus, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In an apparatus for developing photographic materials, a combination comprising at least two adjacent containers each adapted to contain a treating bath for photographic material, said containers having respective ports which face one another; and means forming a passage which connects said ports and through which the photographic material travels from one to the other of said containers, including light trap means in said passage which defines for the photographic material a substantially straight-line travel path dimensioned and configurated for avoiding contact of said light-trap means with emulsion-carrying surfaces of said photographic material, said light-trap means including a circumferential wall and a plurality of baffles projecting inwardly of said wall at locations spaced lengthwise of said passage and forming at least two compartments through which the photographic material is compelled to pass.

2. A combination as defined in claim 1, said baffles being arranged in pairs, and the baffles of each pair projecting towards one another from diametrically opposite parts of said wall and having inner edges which together bound a slot for passage of the photographic material.

3. A combination as defined in claim 2, wherein there are at least three pairs of said baffles.

4. A combination as defined in claim 2, wherein there are at least four pairs of said baffles.

5. A combination as defined in claim 2, wherein there are more than two pairs of said baffles and successive pairs are equidistantly spaced from one another.

6. A combination as defined in claim 2, wherein there are more than two pairs of said baffles and successive pairs are non-uniformly spaced from one another.

7. In an apparatus for developing photographic materials, a combination comprising at least two adjacent containers each adapted to contain a treating bath for photographic material, said containers having respective ports which face one another; and means forming a passage which connects said ports and through which the photographic material travels from one to the other of said containers, and including a light trap in said passage and defining a substantially straight-line travel path for the photographic material, said light trap comprising a circumferential wall and a plurality of baffles projecting inwardly of said wall at locations spaced lengthwise of said passage and forming at least two compartments through which the photographic material is compelled to pass, said baffles being arranged in pairs and the baffles of each pair projecting towards one another from diametrically opposite parts of said wall and having inner edges which together bound a slot for passage of the photographic material, said inner edges each having a central part of a width greater than the width of the photographic material and being flanked by two lateral parts, the central parts of the inner edges of each pair extending substantially parallel to one another and the lateral parts of each inner edge being inclined towards the lateral parts of the opposite inner edge, so that lateral deviations of the photographic material in the slot result only in contact of the lateral edges of the photographic material with said lateral parts.

8. In an apparatus for developing photographic materials, a combination comprising at least two adjacent containers each adapted to contain a treating bath for photographic material, said containers having respective ports which face one another; and means forming a passage which connects said ports and through which the photographic material travels from one to the other of said containers, and including a light trap in said passage and defining a substantially straight-line travel path for the photographic material, said light trap comprising a circumferential wall and a plurality of baffles projecting inwardly of said wall at locations spaced lengthwise of said passage and forming at least two compartments through which the photographic material is compelled to pass, said baffles being arranged in pairs, and the baffles of each pair projecting towards one another from diametrically opposite parts of said wall and having inner edges which together bound a slot of generally elliptical cross-section for passage of the photographic material.

9. In an apparatus for developing photographic materials, a combination comprising at least two adjacent containers each adapted to contain a treating bath for photographic material, said containers having respective ports which face one another; and means forming a passage which connects said ports and through which the photographic material travels from one to the other of said containers, and including a light trap in said passage and defining a substantially straight-line travel path for the photographic material, said light trap comprising a circumferential wall composed of two mirror-symmetrical semi-cylindrical shells and a plurality of baffles projecting inwardly of said wall at locations spaced lengthwise of said passage and forming at least two compartments through which the photographic material is compelled to pass, said baffles being arranged in pairs with one baffle of each pair being carried by a respective one of said shells, and the baffles of each pair projecting towards one another from diametrically opposite parts of said wall and having inner edges which together bound a slot for passage of the photographic material.

10. A combination as defined in claim 9, wherein said means comprises a conduit in which said shells are fixedly mounted.

11. A combination as defined in claim 10, at least one of said circumferential wall and said conduit being of elastically deformable material.

12. A combination as defined in claim 11, wherein said elastically deformable material is rubber.

13. A combination as defined in claim 11, wherein said elastically deformable material is synthetic plastic.

14. A combination as defined in claim 10, wherein said conduit and said shells are each of one piece and of elastically deformable material.

15. A combination as defined in claim 9, said shells having non-reflecting inner surfaces.

16. In an apparatus for developing photographic materials, a combination comprising at least two adjacent containers each adapted to contain a treating bath for photographic material, said containers having respective ports which face one another; and means forming a passage which connects said ports and through which the photographic material travels from one to the other of said containers, and including a light trap in said passage and defining a substantially straight-line travel path for the photographic material, said light-trap comprising a circumferential wall and a plurality of pairs of baffles projecting at spaced locations inwardly from said wall and having inner edges forming slots for the passage of the photographic material, said baffles forming a plurality of successively arranged compartments; a hole at the bottom of each of said compartments; and a channel communicating with all of said holes and with said one container so that treating liquid dripping off the photographic material is returned into said one container via said channel.

17. A combination as defined in claim 16, said wall being composed of two mirror-symmetrical shell sections each having one baffle of each of said pairs, one of said shell sections being located below the other and provided with said holes and with said channel.

18. A combination as defined in claim 17, said one shell section having an outer surface, and said channel being formed at said surface.

* * * * *